US010472925B2

(12) United States Patent
Hiorth et al.

(10) Patent No.: US 10,472,925 B2
(45) Date of Patent: Nov. 12, 2019

(54) WELL TOOL DEVICE WITH ACTUATION DEVICE IN THROUGH OPENING OF FRANGIBLE DISC

(71) Applicant: Vosstech AS, Voss (NO)

(72) Inventors: Espen Hiorth, Trondheim (NO); Stig Ove Bjørgum, Voss (NO)

(73) Assignee: Vosstech AS, Voss (NO)

( * ) Notice: Subject to any disclaimer, the term of this patent is extended or adjusted under 35 U.S.C. 154(b) by 26 days.

(21) Appl. No.: 15/520,773

(22) PCT Filed: Nov. 10, 2015

(86) PCT No.: PCT/EP2015/076195
§ 371 (c)(1),
(2) Date: Apr. 20, 2017

(87) PCT Pub. No.: WO2016/075132
PCT Pub. Date: May 19, 2016

(65) Prior Publication Data

US 2017/0321518 A1 Nov. 9, 2017

(30) Foreign Application Priority Data

Nov. 10, 2014 (NO) ..... 20141337

(51) Int. Cl.
*E21B 29/00* (2006.01)
*E21B 33/134* (2006.01)
(Continued)

(52) U.S. Cl.
CPC ..... *E21B 34/063* (2013.01); *E21B 33/12* (2013.01); *E21B 33/134* (2013.01)

(58) Field of Classification Search
CPC ..... E21B 29/00; E21B 31/002; E21B 33/134; E21B 34/063
See application file for complete search history.

(56) References Cited

U.S. PATENT DOCUMENTS 1,433,518 A * 10/1922 Kraft ..... F16L 27/082 285/347
8,459,344 B1 * 6/2013 Stone ..... E21B 33/12 166/114
(Continued)

FOREIGN PATENT DOCUMENTS

GB 2437657 A 10/2007
NO 331150 B1 9/2009
(Continued)

OTHER PUBLICATIONS

International Search Report issued in PCT/EP2015/076195 dated Jan. 25, 2016 (2 pages).
(Continued)

*Primary Examiner* — Cathleen R Hutchins
(74) *Attorney, Agent, or Firm* — Osha Liang LLP

(57) ABSTRACT

A well tool device includes a housing with a through bore having a first end and a second end. A frangible obstruction device is provided inside the longitudinal bore, where fluid flow between the first end and the second end is prevented due to the frangible obstruction device. The frangible obstruction device includes a through opening. The well tool device further includes an actuation device extending fluid-tight at least into the through opening. The actuation device includes an actuation tool connection interface and a disintegration device. The disintegration device is configured to be at least partially moved into the frangible obstruction device and thereby provide disintegration of the frangible obstruction device, hence allowing fluid flow between the first end and the second end of the through bore.

10 Claims, 8 Drawing Sheets

(51) Int. Cl.
*E21B 34/06* (2006.01)
*E21B 33/12* (2006.01)

(56) References Cited

U.S. PATENT DOCUMENTS

| | | | | |
|---|---|---|---|---|
| 2011/0277988 | A1* | 11/2011 | Wee | E21B 33/1208 166/192 |
| 2012/0125631 | A1* | 5/2012 | Entchev | E21B 33/12 166/376 |

FOREIGN PATENT DOCUMENTS

| | | | |
|---|---|---|---|
| NO | 20110630 | A1 | 10/2012 |
| NO | 20130427 | A1 | 3/2014 |
| WO | 2010/120774 | A1 | 10/2010 |
| WO | 2012/146707 | A2 | 11/2012 |

OTHER PUBLICATIONS

Written Opinion of the International Searching Authority issued in PCT/EP2015/076195 dated Jan. 25, 2016 (5 pages).
Norwegian Search Report issued in Patent Application No. 20141337 dated May 27, 2015 (2 pages).

* cited by examiner

WELL TOOL DEVICE WITH ACTUATION DEVICE IN THROUGH OPENING OF FRANGIBLE DISC

FIELD OF THE INVENTION

The present invention relates to a well tool device.

TECHNICAL BACKGROUND

There are several well tools, such as plugging devices, for use in oil and/or gas wells, having a housing with a through bore, a frangible disc provided in the through bore and a breaking mechanism provided in the housing for breaking the frangible disc. In the initial state, the frangible disc will prevent fluid flow through the bore. After the frangible disk has been broken, fluid flow through the bore is allowed.

In the oil industry it is known that different types of plugging devices are used during pressure testing of petroleum wells, for example, before start-up of production from the well, or when extensive maintenance of the well has been carried out. A plugging device will then be installed in the well, after which an area of the well will be pressurised, so as to check that pipe joints, packers, valves etc. are properly installed, and whether they are also leak-tight. The plugging device is usually installed as a lower part of production tubing, the plugging device then being arranged in a pipe element that is designed to be connected with one or more pipe elements forming the production tubing. The plug may also be arranged in an independent pipe element which will then be capable of being run down inside a liner or a casing, the liner or casing being installed in the well beforehand.

Once the pressure testing has been completed and production is to start up, the plugging device must be removed from the well, either by the plugging device being retrieved or by the whole or parts of the plugging device being destroyed downhole.

Such plugging devices comprise an outer housing, in which outer housing is arranged one or more elements that will prevent a fluid flow across the plugging device.

Plugging devices that are to be retrieved from the well may be connected to a wire (wireline) or the like, whereby the wire is used to retrieve the plugging device. Such plugging devices might, however, become wedged during retrieval or, in particular if downhole for a long time, they might have reacted with the tubing in which, for example, they are arranged, and so become stuck, which means the plugging devices are difficult or even impossible to bring up to the surface again.

For the above reasons, so-called destructible plugging devices have been developed, where the plugging device remains in the well, but where parts of the plugging device are destroyed such that a fluid flow is permitted across the plugging device. Such destructible plugging devices are made of one or more materials that will dissolve when the material/materials come into contact with a liquid, for example, a chemical or water. For instance, such a plugging device may be made of a rubber material, this rubber material being brought into contact with the well fluid or the chemical once testing of the well has been carried out, so as to dissolve the rubber material.

However, during operations from floating rigs, this method will be far too unreliable and slow, seen in the light of the operating costs for such a platform. In this case, it will not be possible to predict the exact time at which the plugging device is removed and passage through the well opens.

Such destructible plugging devices can also be made of a material that can be broken up or crushed by using explosives or mechanical loading devices, where this material, for example, may be of glass, ceramics or the like. Use of explosives will provide a sure removal of the plugging device, but will be a safety risk, and there are also many countries that have stringent requirements regarding the use and import of explosives. Mechanical loading devices are often highly complex and thus prone to faults.

Such tools are for example known from NO 20130427, NO 20110630, NO 20081192, all of which are owned by Vosstech AS.

The disadvantage of the prior art tools are that the breaking mechanisms are relatively complex and/or not possible to predict the time at which the plugging device is removed, with the result that their operation may be unreliable. Hence, one or more embodiments of the present invention may provide a tool with a more reliable breaking mechanism.

An actuation tool is often required. First, a bailing operation is performed in order to remove debris, mud etc. above the tool to provide access to a connection interface of the tool, then the actuation tool is connected to the connection interface of the tool and finally the actuation tool is used to actuate the breaking mechanism to break the frangible disk, Hence, one or more embodiments of the present invention may provide a tool where the bailing operation can be omitted or simplified.

WO 2010/120774 A1 describes a bridge plug arrangement with a plug made of a frangible material which may be broken into a plurality of pieces. The plug has an opening in which a mandrel is connected by means of nuts. It is shown that the plug can be disintegrated by applying a force to the mandrel by means of a jar. There are several disadvantages with this type of solution. First of all, there is contact between the nuts and plug, which, when glass is used as a plug material, increases the risk for unintentional disintegration of the glass during topside handling of the arrangement and during insertion into the well. In order to reduce the risk of such unintentional disintegration of the glass, the contact area between glass/nuts should be large. However, a large contact surface area will make it difficult to disintegrate the plug intentionally again by forcing the nut into the glass.

NO 331150 B1 describes a device for removal of a plug which is used in a well, a pipe, or the like for carrying out tests. An element is arranged to penetrate into the plug material so that this is crushed, said element is arranged to be supplied said force from an above lying element. The element is preferably a ring, the lower end of which is arranged to be forced in a radial direction into the plug element at axial driving of a hydraulic pressure piston.

GB 2437657 describes a well isolation device having an axial passage in fluid communication above and below the device. A frangible barrier seals the passage to block fluid flow through the passage and thereby bears a load from fluid pressure. A structural element acts on the frangible barrier to selectively redirect the load on the frangible barrier element, thereby preventing or facilitating rupture. The structural element may be a disengagable constraint formed by a movable sleeve that forms a compression-loaded structure when in contact with the frangible barrier. Upon disengagement, the frangible barrier bears a primarily tensile load that facilitates its rupture. The frangible barrier may be hemispherical.

Magnum Oil Tools is marketing a plugging device called "Dual MagnumDisk" (http://www.magnumoiltools.com/dual-magnumdisk) comprising two half-spherical ceramic discs used as a pressure barrier. A product video (http://www.youtube.com/watch?v=mVTH62opPzc, at ca 1:58) discloses a spear submerged down into the well, breaking the ceramic discs by applying a stroke onto the discs. The disadvantage here is, as mentioned above, that debris, sand, mud etc will obstruct the well above the discs, making it impossible to achieve contact between the spear and the discs. Hence, a bailing operation will be necessary.

One or more embodiments of the present invention may provide a plugging device that will provide a safe and reliable destruction of the plugging device.

SUMMARY OF THE INVENTION

One or more embodiments of the present invention may provide a plugging device according to the attached claims, with further details of the invention set forth in the description below.

DETAILED DESCRIPTION

In the following, embodiments of the invention will be described with reference to the enclosed drawings, where:

Figure 1:
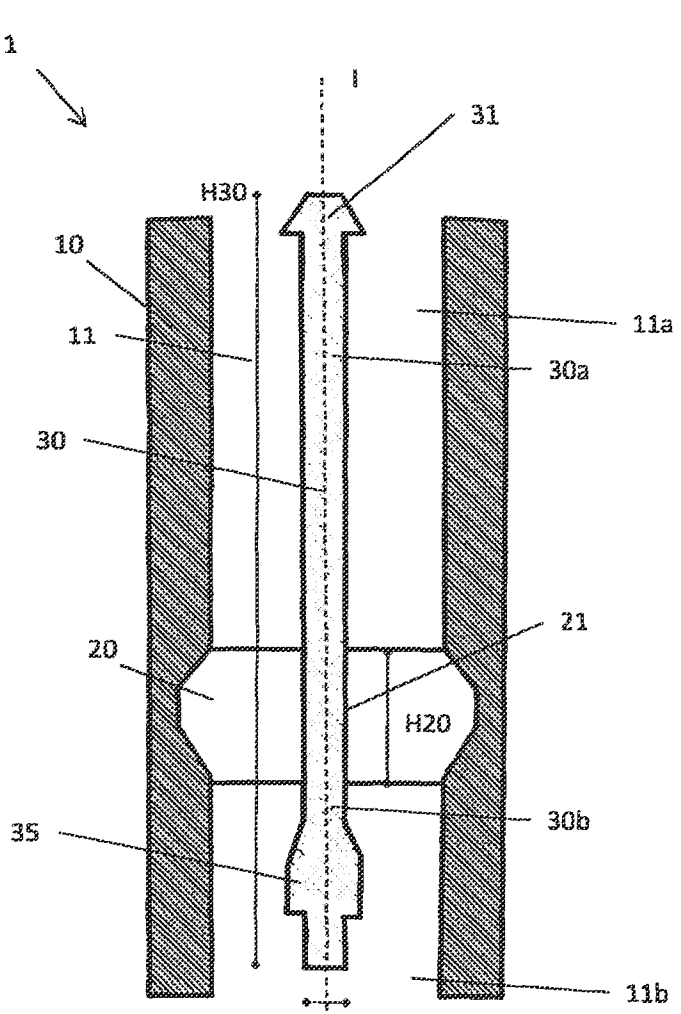
FIG. 1 illustrates a first embodiment of the invention schematically.

It is now referred to FIG. 1. Here, the cross section of a well tool device 1 is shown schematically. The well tool device 1 comprises a housing 10 comprising a longitudinal through bore 11 having a first end 11*a* and a second end 11*b*. The housing 10 could be a part of a well pipe, for example drill pipe, or it can be a part of an inner mandrel of a plugging device, such as a plug, a packer, etc. This will be explained more in detail below. Hence, the well tool device 1 is a part of a well tool.

The well tool device 1 further comprises at least one frangible obstruction device 20. The frangible obstruction device 20 is fixed inside the longitudinal bore 11. The housing 10 may for example comprise a recess 12 provided on its inner surface 13 (see FIG. 3) for receiving and supporting the frangible obstruction device 20.

The purpose of the frangible obstruction device 20 is to prevent fluid flow from the first end 11*a* to the second end 11*b* of the bore 11. The frangible obstruction device 20 is for example made of glass, such as hardened glass, ceramics, or other suitable materials. Such materials are well known for a skilled person.

The frangible obstruction device 20 comprises a through opening 21. In one or more embodiments, the opening 21 is made in the center of the obstruction device 20, in the axial direction of the well tool device, Le, parallel with or coinciding with the longitudinal axis I shown in FIG. 1.

The well tool device 1 further comprises an actuation device 30 extending fluid-tight through the through opening 21 with a first section 30*a* provided on a first side of the frangible obstruction device 20 and a second section 30*b* provided on a second side of the frangible obstruction device 20. The actuation device 30 may for example comprise a steel rod with a circular cross section. In one or more embodiments, the center axis of the actuation device 30 is parallel with or coinciding with the center axis I of the well tool device 1, Axial displacement of the actuation device 30 in relation to the obstruction device 30 is possible when a downwardly or upwardly directed force above a certain threshold is applied to the actuation device 30.

Sealing elements, for example O-rings, are provided radially between the obstruction device 20 and the housing 10 in order to prevent fluid flow from the first end 11*a* to the second end 11*b* of the bore 11. In addition, sealing elements, for example O-rings, are provided radially between the actuation device 30 and the obstruction device 20 in order to prevent fluid flow from the first end 11*a* to the second end 11*b* of the bore 11. These O-rings are not shown in FIG. 1, but are indicated in FIGS. 9, 12, 13 and 14. The O-rings may provide that a certain threshold force must be applied to the actuation device 30 in order to displace it axially.

The actuation device 30 comprises an actuation tool connection interface 31 for connection to a connection interface (not shown) of an actuation tool (not shown). In FIG. 1, the actuation tool connection interface 31 is a fish neck type of connection interface. This and other types of connection interfaces are well known for the skilled person and will not be described here in detail. The actuating tool connection interface 31 is typically provided in the upper end of the actuating device. It should be noted that the term "upper" here means closest to the top of the well, and that the term "lower" here means closest to the bottom of the well, i.e. the well tool device 1 can also both in horizontal wells and in vertical wells.

In the drawings, the actuation device 30 is relatively short, having a height H30 being approximately 5-10 times the height H20 of the obstruction device 20. It is &so shown that the outer diameter D30 of the actuation device 30 is smaller than the inner diameter D20 of the housing 10. Hence, an annular compartment is formed in the bore 11, radially between the actuation device 30 and the housing 10. As mentioned in the introduction above, debris and/or mud will also here be present above the obstruction device 20 when it is located in a oil and/or gas well. Hence, the height H30 of the actuation device 30 may in one or more embodiments be substantially larger than the height H20 of the obstruction device 20, for example from hundred to thousand times larger. For example the obstruction device may have a height H20 of 2 cm, while the height H30 of the actuating device 30 may be 200-500 cm, or even longer, dependent of the expected amount of mud and debris. Hence, it can be achieved that the actuation tool connection interface 31 is not covered with debris and mud, and hence that the bailing operation can be omitted. At least, the bailing operation may be considerably reduced.

The actuation device 30 further comprises a disintegration device 35. The disintegration device 35 is configured to be at least partially moved into the frangible obstruction device 20, and thereby provide disintegration of the frangible obstruction device 20. In FIG. 1, the disintegration device 35 is illustrated as a radial protrusion on the actuation device 30, below the frangible obstruction device 20.

The disintegration device 35 may comprise protrusions protruding radially from the actuation device. The protrusions may have a tapering or pointed shape. They may comprise pins, spikes, blades, knifes etc.

Figure 3:
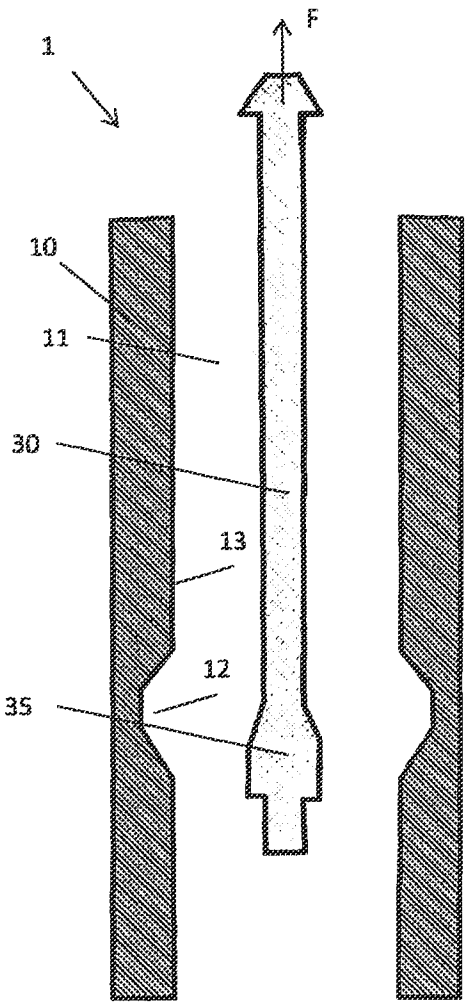
FIG. 3 illustrates well tool device after the disintegration of the frangible obstruction device schematically.
Figure 2:
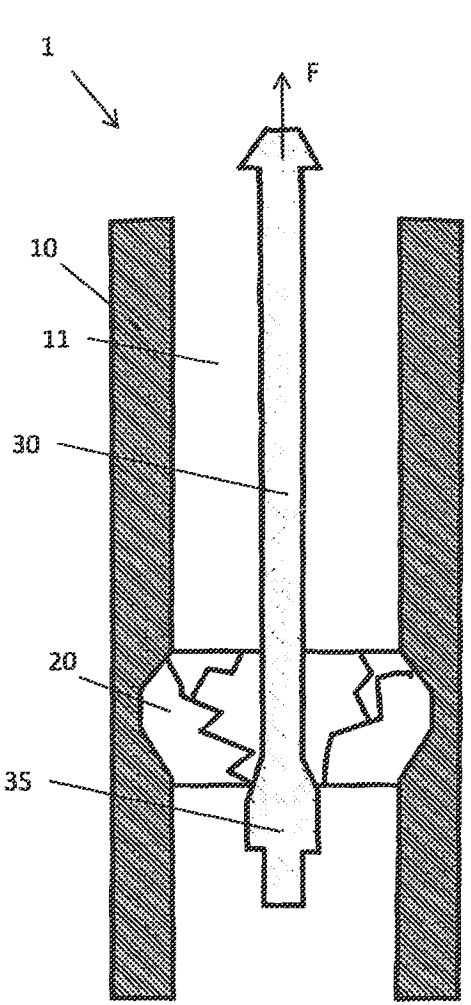
FIG. 2 illustrates the disintegration of the frangible obstruction device in the first embodiment schematically.

In FIG. 2, it is shown that the actuation device 30 is pulled upwardly (arrow F), causing the disintegration device 35 to be moved into the frangible obstruction device and thereby provide disintegration of the frangible obstruction device 20. As shown, the material of the obstruction device 20 is broken into smaller pieces and will fall down or be guided away with the fluid flow (either upwards or downwards). In FIG. 3, it is shown that fluid flow is allowed between the first end 11*a* and the second end 11*b* of the through bore 11.

Figure 5:
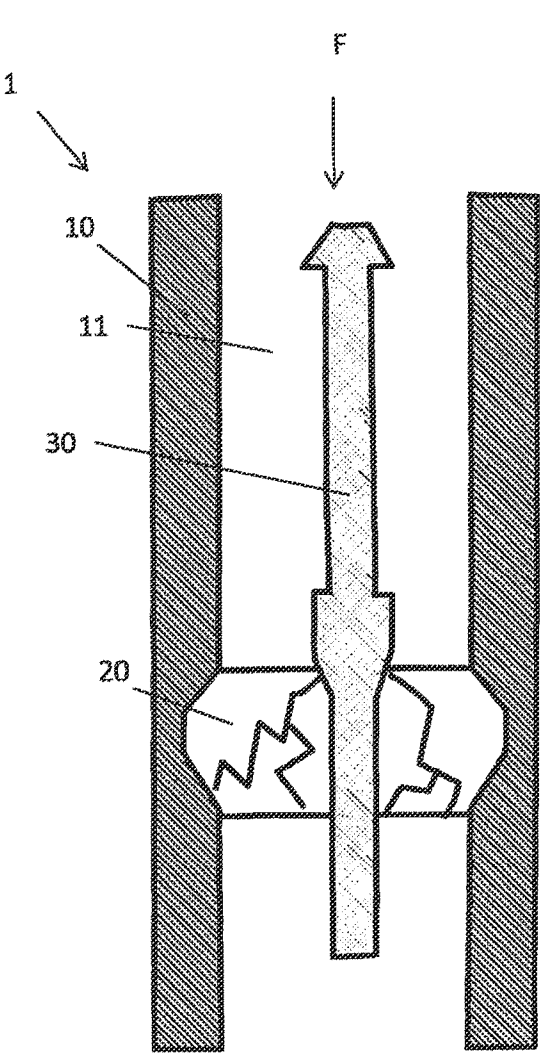
FIG. 5 illustrates the disintegration of the frangible obstruction device in the second embodiment schematically.
Figure 4:
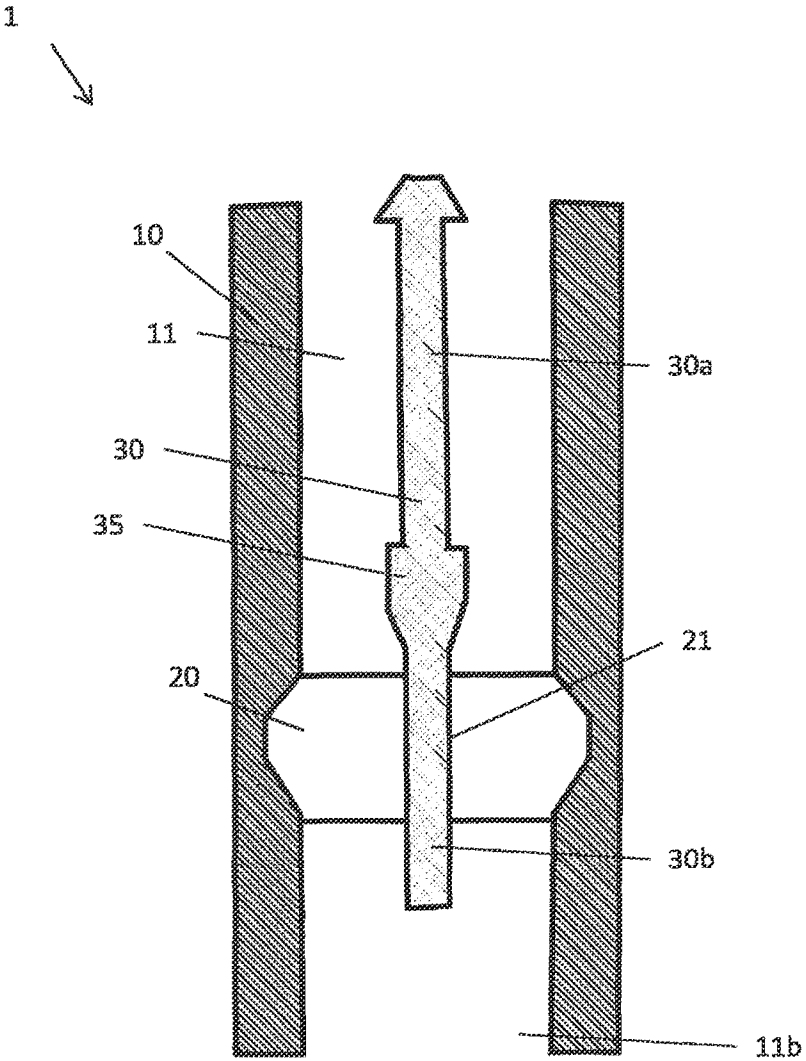
FIG. 4 illustrates a second embodiment of the invention schematically.

It is now referred to FIG. 4. This embodiment corresponds substantially to the above described embodiment. However, here the disintegration device 35 is illustrated as a radial protrusion on the actuation device 30 above the frangible obstruction device 20. Hence, there the actuation device 30 must be forced downwardly (arrow F) in order to provide disintegration of the frangible obstruction device 20, as indicated in FIG. 5.

Figure 6:
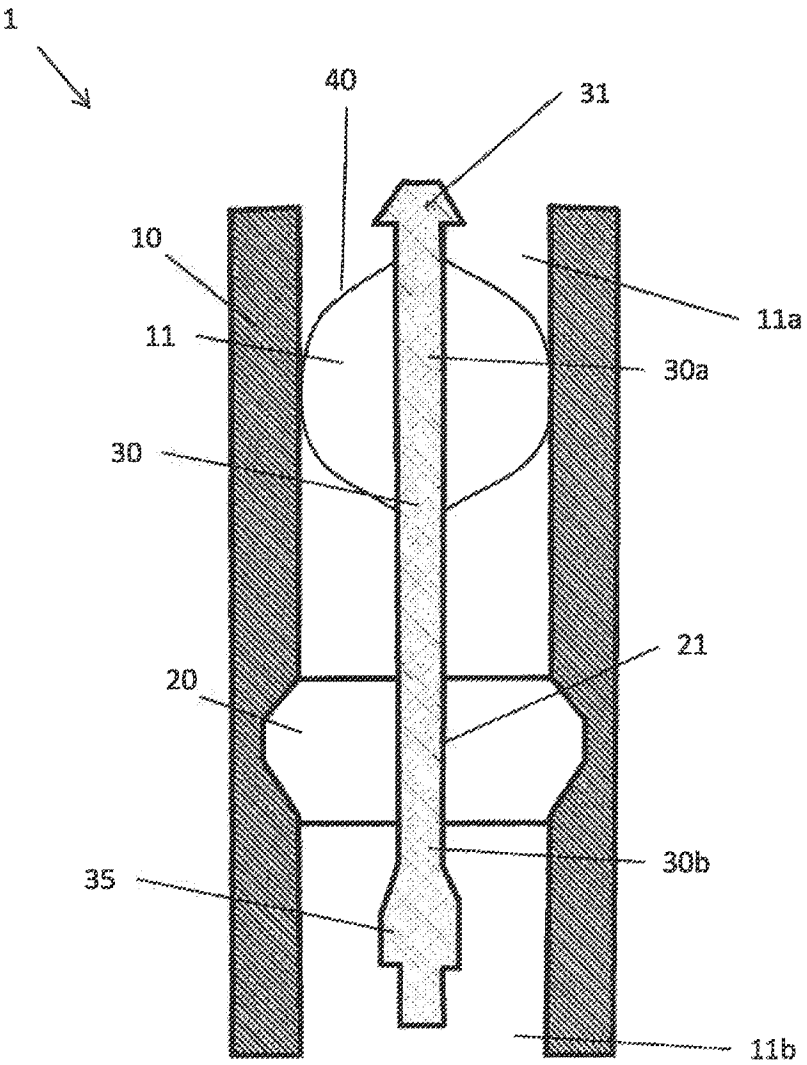
FIG. 6 illustrates a third embodiment of the invention schematically.

It is now referred to FIG. 6. In this embodiment, the well tool device 1 further comprises a supporting element 40 for supporting the actuation device 30 in relation to the housing 10. In embodiments where the actuation device 30 is long, there is a risk that radial movement of the actuation device 30 may cause unintentional disintegration of the frangible obstruction device 20. By means of the supporting elements 40, such radial movement is prevented. The supporting element 40 may for example be a centralizer, such as a bow-spring centralizer shown in FIG. 6, having 3 or more bow-springs.

Figure 7:
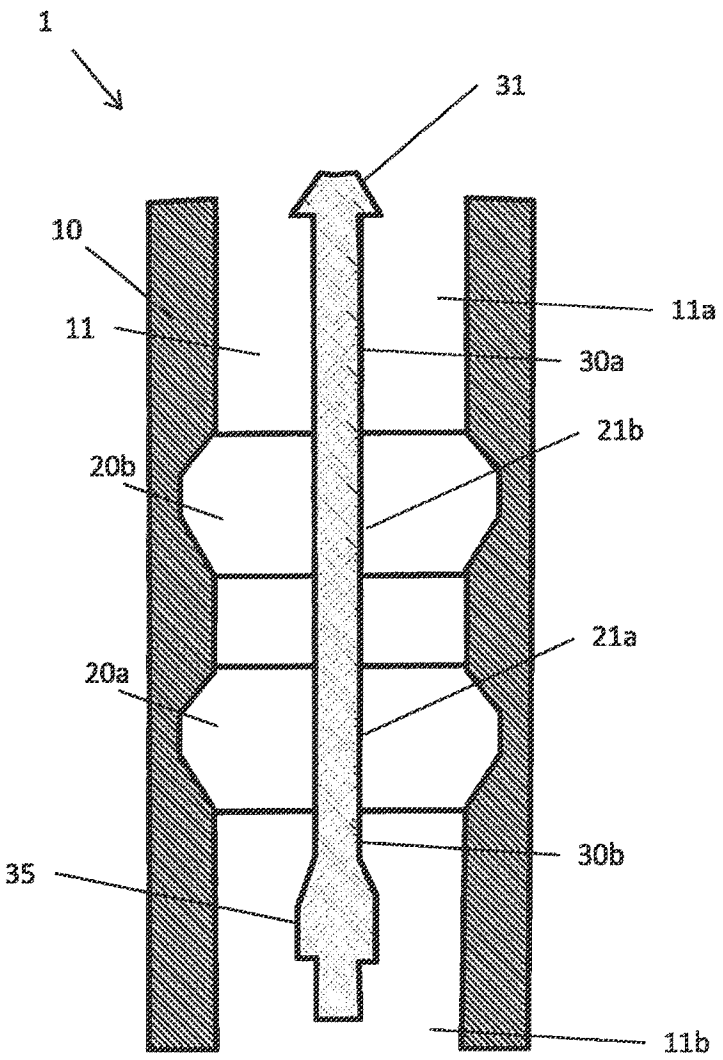
FIG. 7 illustrates a fourth embodiment of the invention schematically.

It is now referred to FIG. 7. Here it is shown that the well tool comprises two frangible obstruction devices 20*a*, 20*b* fixed inside the longitudinal bore 11. In FIG. 7 it is shown that there is a space between the obstruction devices 20*a*, 20*b*, but it is also possible that they are in contact with each other. In FIG. 7, there is one actuating device 30 provided through both of the frangible obstruction devices 20*a*, 20*b* and there is one disintegration device 35 which is used to provide disintegration of both of the frangible obstruction devices 20*a*, 20*b*.

Figure 8:
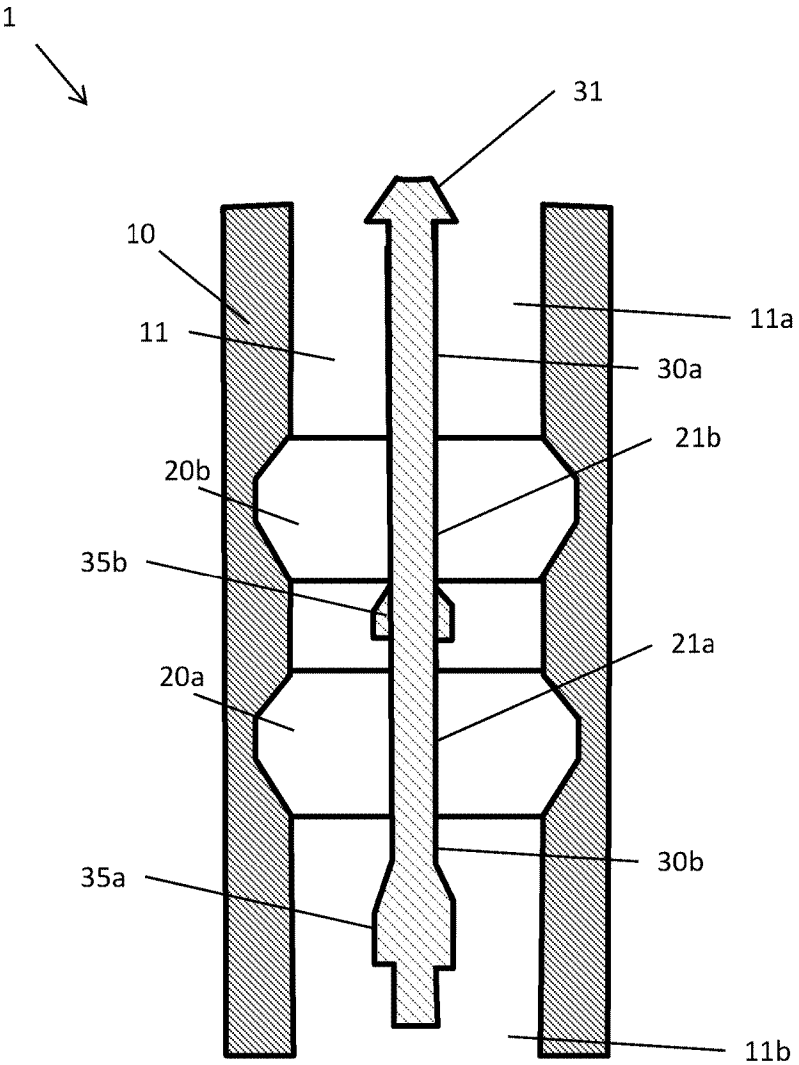
FIG. 8 illustrates a fifth embodiment of the invention schematically.

It is now referred to FIG. 8. This embodiment substantially corresponds to FIG. 7. Here, the actuating device 30 comprises two disintegration devices; a first disintegration device 35*a* below the lower obstruction device 20*a* and a second disintegration device 35*b* below the second obstruction device 20*b*.

Figure 9:
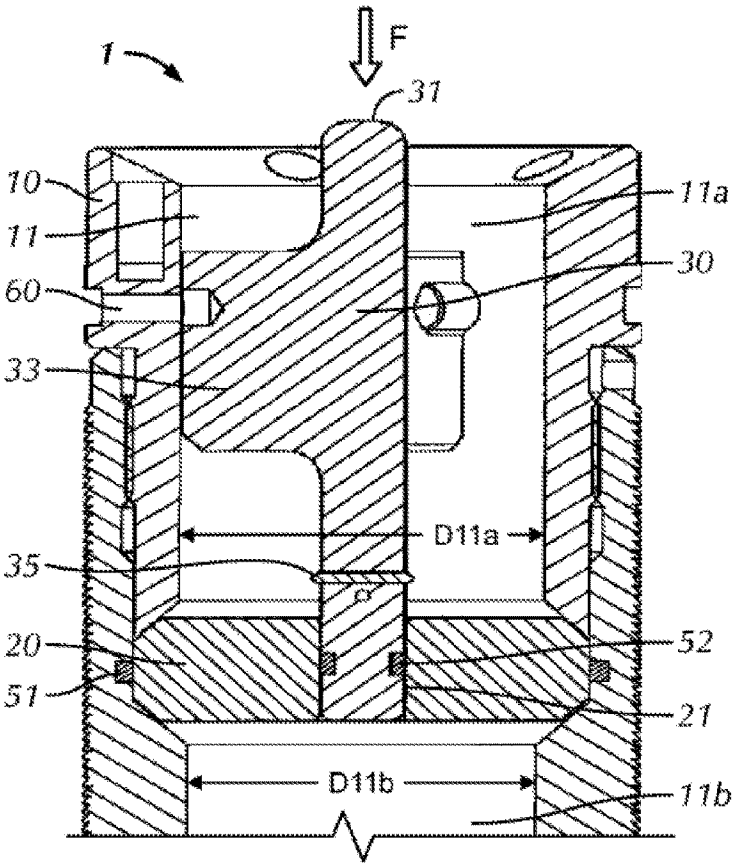
FIG. 9 illustrates the invention used as a pressure equalizing device in a well tool.

It is now referred to FIG. 9. Here, the well tool device 1 is used as an equalizing device in a plugging device. Again, the well tool device 1 is similar to the embodiments described above, with the housing 10 having a through bore 11, with the frangible obstruction device 20 and the actuating device 30. It should be noted that here, the actuating device 30 is not extending entirely through the opening 21. In FIG. 9 it is shown that the actuation device 30 is only extending fluid-tight into the through opening 21, the actuating device 30 is not protruding out from the lower side of the obstruction device 20.

Here, the O-ring 51 between the housing 10 and the frangible obstruction device 20 is shown and also the O-ring 52 in the opening 21 between the actuating device 30 and the obstruction device 20 is shown. Here, the disintegration device 35 comprises a knife element fixed to the actuating device 30 above the frangible obstruction device 20.

As shown in FIG. 1, a radially protruding supporting section 33 of the actuating device 30 is in contact with the housing 10. The well tool device 1 further comprises a shear pin 60 fixing the actuating device 30 to the housing 10. In this embodiment, the actuating tool connection interface 31 is a contact surface.

Here, the actuating tool is brought into contact with the contact surface 31 and a downwardly directed pressure is applied to the actuating device 30. When a predetermined pressure is applied, the shear pin breaks and hence, the actuating device 30 will move downwards and the knife element 35 will provide disintegration of the frangible obstruction device 20. In this way, the risk of unintentional disintegration of the frangible obstruction device 20 is reduced.

Figure 10:
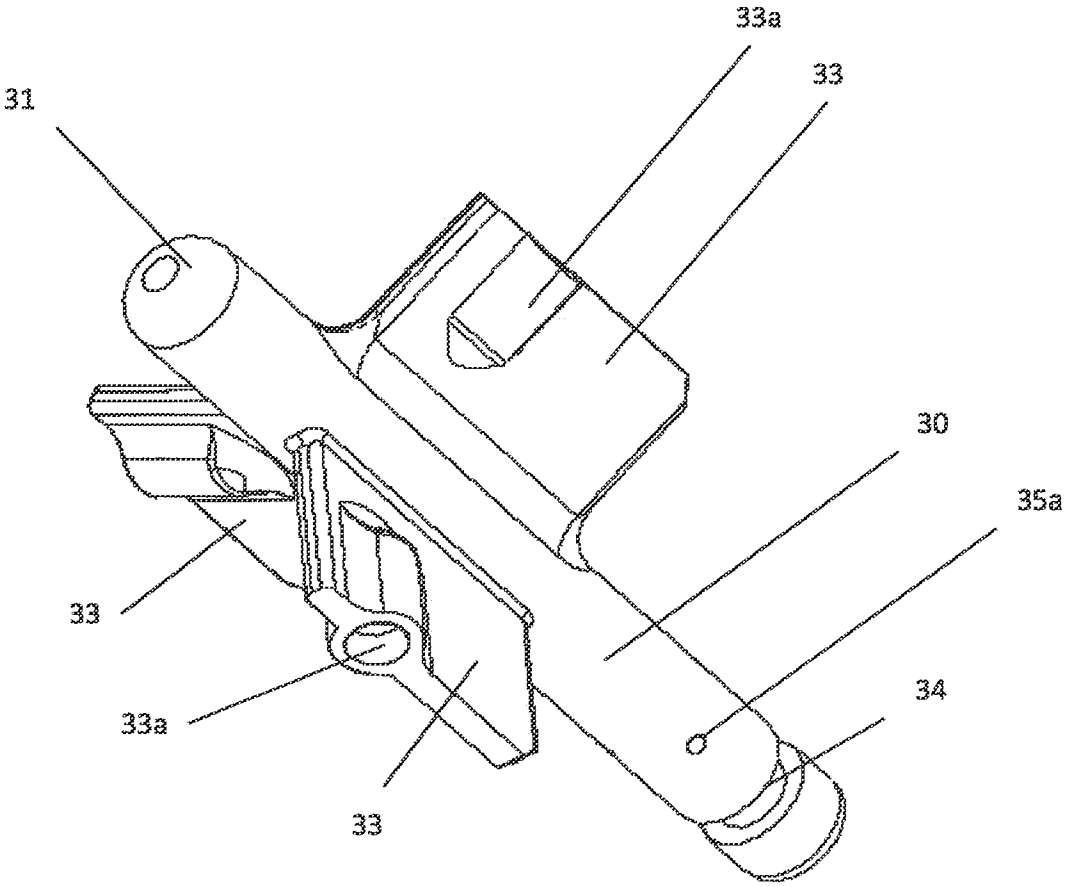
FIG. 10 illustrates a perspective view of the actuating device of FIG. 9.

In FIG. 10, the actuating device 30 is illustrated. Here, it is shown that the device 30 comprises three such radially protruding supporting sections 33, each having an opening 33*a* for the shear pin 60. In this embodiment, the actuating device 30 itself is providing support against the housing 10, and hence, there is no need for the supporting device 40 of FIG. 6.

In FIG. 10, a radial recess 34 is indicated. The O-ring 52 may be provided in the radial recess 34. An opening 35*a* for the knife element 35 is also shown.

In order to prevent the actuating device 30 from falling into the well, the diameter D11*a* in the upper part of the bore 11*a* is larger than the diameter D11*b* of the lower part of the bore 11*b*.

Figure 11:
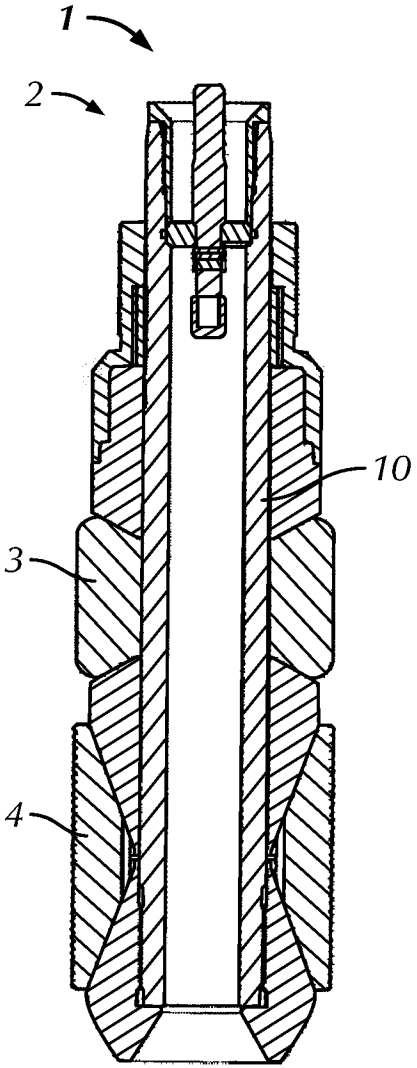
FIG. 11 illustrates a plugging device, in which the invention is used as a pressure equalizing device.

It is now referred to FIG. 11, where a plugging device 2 with a well tool device 1 is shown. The housing 10 of the well tool device 1 is a part of the mandrel of the plugging device 2. The plugging device 2 comprises an anchoring device 3 for anchoring to the inner surface of a well, and a sealing device 4 for sealing against the inner surface of the well. These parts of the plugging device 2 are considered known for a skilled person. The well tool device 1 is provided in the upper part of the plugging device 2.

Figure 12:
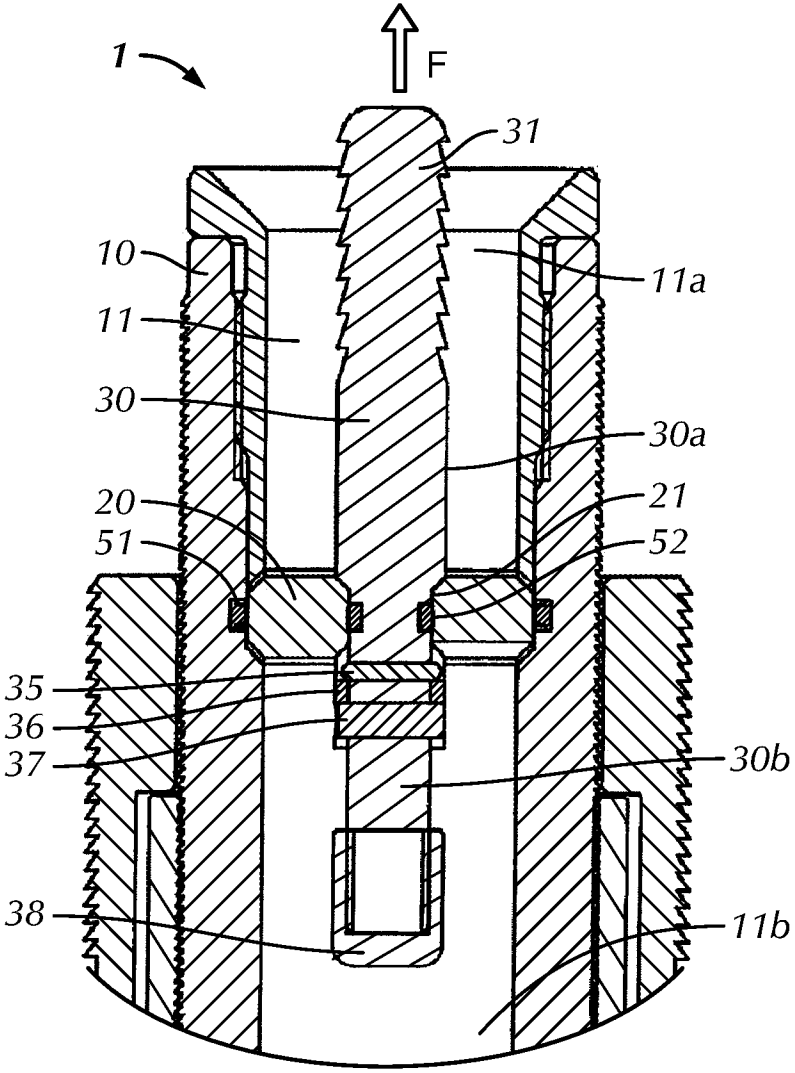
FIG. 12 is an enlarged view of the pressure equalizing device of FIG. 10.

FIG. 12 shows an enlarged view of the well tool device 1 of FIG. 11. Again, the well tool device 1 is similar to the embodiments described above, with the housing 10 having a through bore 11, a frangible obstruction device 20 and an actuating device 30.

Here, the O-ring 51 between the housing 10 and the frangible obstruction device 20 is shown and also the O-ring 52 in the opening 21 between the actuating device 30 and the obstruction device 20 is shown. Here, the disintegration device 35 comprises a knife element 35 fixed to the actuating device 30 below the obstruction device 20.

In order to avoid unintentional disintegration of the frangible obstruction device 20, a sleeve 36 is provided around the actuating device 30 below the obstruction device 20. The outer diameter of the sleeve 36 is larger than the diameter of the opening 21. A shear pin 37 is locking the sleeve 36 to the actuation device 30. A radial protrusion 38, for example a cup or flange, is connected to the lower part or end of the actuating device 30.

If there is a high pressure below the obstruction device 20, there is a risk that the pressure would force the actuating device 30 and hence the knife element 35 upwardly and hence cause an unintentional disintegration of the obstruction device 20. In the embodiment of FIG. 12, the sleeve 36 fixed to the actuating device 30 by means of the shear pin 37 will prevent such a movement. However, a pulling force above the threshold given by the shear pin will break the shear pin 37. Now, the actuating device 30 with the knife 35 can be pulled upwardly and disintegrate the obstruction device 20. The purpose of the radial protrusion 38 is to prevent that the sleeve 36 is falling into the well.

Initially, the plugging device 2 is in its radially retracted or run state in which it is run to the desired location in the well. At the desired location the anchoring device 3 and sealing device 4 is brought to its radially expanded or set state. Fluid flow between the upper side of the plug 2 and the lower side of the plugging device 2 is now prevented. A pressure difference between the upper and lower side of the plugging device 2 may now build up.

By using an actuating tool (not shown), the obstruction device 20 can be disintegrated, as described above. The pressure difference will now be equalized, which often is desired or even required before retrieval of the plugging device.

Figure 13:
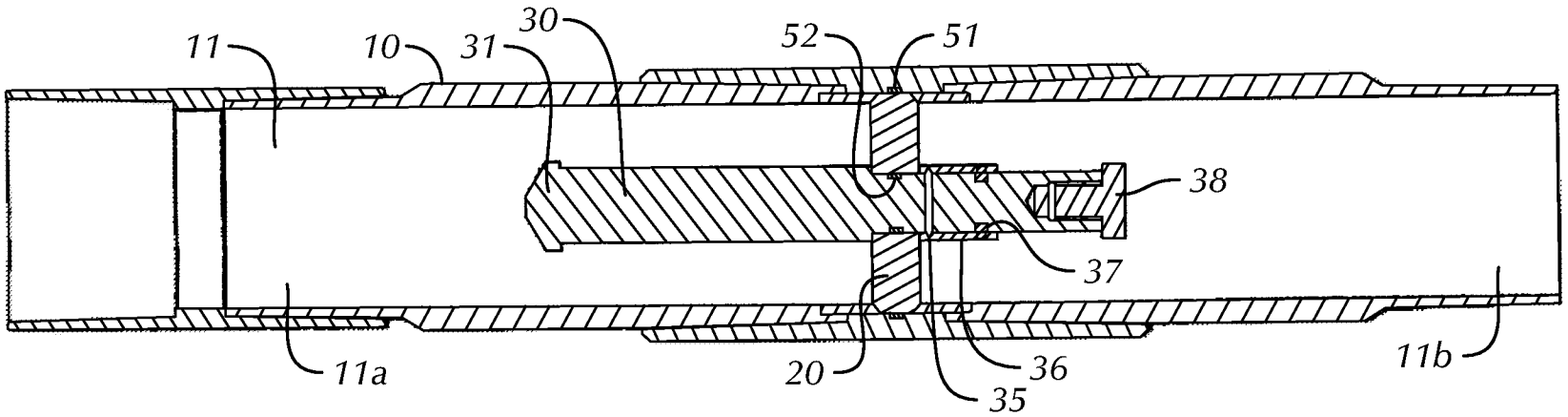
FIG. 13 illustrates a part of a production tubing, in which the invention is used as a removable pressure barrier.

It is now referred to FIG. 13. Again, the embodiment is similar to the above embodiments. Here, the housing 10 is a part of a production tubing. The upper part of the pipe is shown to the left in FIG. 13. Similar to FIG. 12, the knife element 35 is located below the obstruction device 20. Also here, sleeve 36, shear pin 37, and radial protrusion 38 are provided to prevent unintentional disintegration of the frangible obstruction device. The radial protrusion 38 is here a T-shaped element fixed into an opening in the lower end of the actuating device 30.

Figure 14:
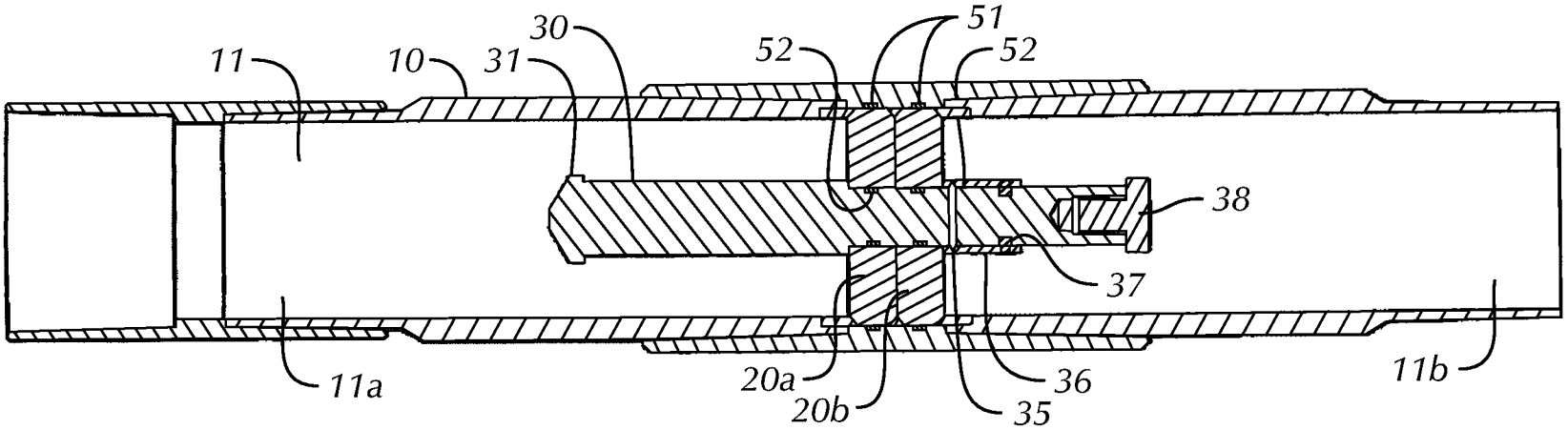
FIG. 14 illustrates an alternative embodiment to the one shown in FIG. 13.

It is now referred to FIG. 14. The embodiment is similar to the one shown in FIG. 13. However, the well tool device 1 here comprises two frangible obstruction devices 20*a*, 20*b*.

Figure 15:
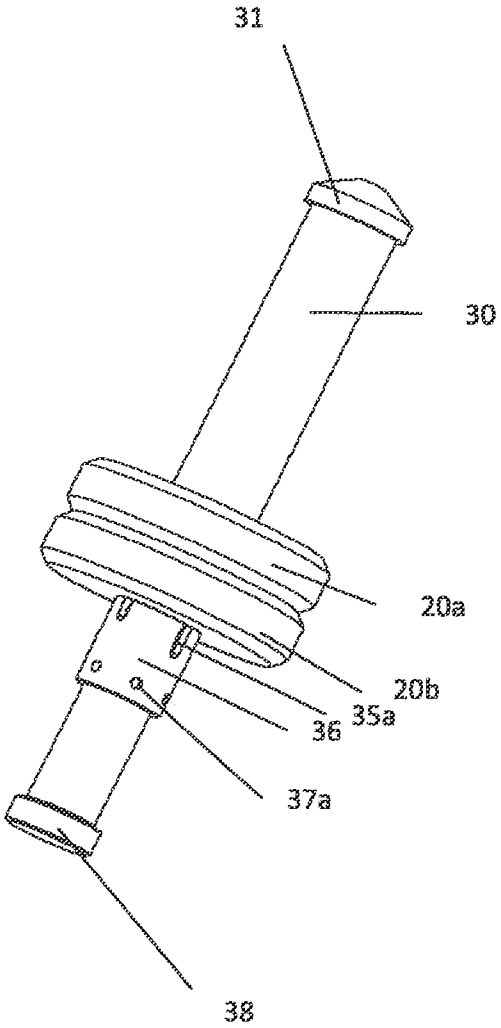
FIG. 15 illustrates a perspective view of the actuating device and the frangible obstruction device of FIG. 14.

It is now referred to FIG. 15. Here the actuating device 30 from FIG. 14 is shown in perspective, with the two frangible obstruction devices 20*a*, 20*b* provided radially outside. The sleeve 36 is also shown below the frangible obstruction devices 20*a*, 20*b*.

It is also shown openings 37*a* for the shear pins and openings 35*a* for the knife elements 35.

It should be noted that a layer of a sheet material, a fluid or another type of leveling material can be provided on the surface of the obstruction device 20, for example between the two obstruction devices 20*a*, 20*b* in FIG. 7 or FIG. 14, in order to level out an uneven surface of the obstruction devices caused by the hardening process of glass.

It is also possible that the length of the actuation device 30 is considerably longer than the above example. If the well tool device 1 is used in a completing pipe, the actuation device 30 may comprise joints so that when an additional section of completing pipe is added to the pipe string, a additional length of the actuation device is also added. In this way it can be achieved that the frangible obstruction device 20 is located in a horizontal part of the well, while the connection interface 31 is located in the vertical part of the well and hence be readily available for the actuation tool.

It is also possible to use a sealing element in the form of a compression seal fitting between the actuating device 30 and the obstruction device 20 instead of O-rings to prevent fluid flow between the upper and lower parts of the bore 11.

It should also be noted that it is possible to provide a disintegration device 35 on both sides of the frangible obstruction device 20. In such an embodiment, the obstruction device 20 will be disintegrated if the actuation device 30 is pushed downwardly or if the actuation device 30 is pulled upwardly.

It is also possible to use a sleeve 36 above the obstruction device 20 or on both sides of (i.e. above and below) the obstruction device In the above embodiments, a cylindrical obstruction device has been used. Of course, the obstruction device may be half-spherical, spherical or have other shapes.

The invention claimed is:

1. A well tool device, comprising:

a housing comprising a longitudinal through bore having a first end and a second end;

at least one frangible obstruction device provided inside the longitudinal through bore, wherein fluid flow between the first end and the second end is prevented due to the frangible obstruction device;

wherein the housing prevents motion of the at least one frangible obstruction device in either direction parallel to the longitudinal through bore, wherein the at least one frangible obstruction device comprises a through opening, wherein the well tool device further comprises an actuation device extending fluid-tight at least into the through opening, wherein the actuation device comprises an actuation tool connection interface, wherein the actuation device comprises at least one disintegration device, wherein the at least one disintegration device is configured to be at least partially moved into the at least one frangible obstruction device and thereby provide disintegration of the at least one frangible obstruction device, hence allowing fluid flow between the first end and the second end of the longitudinal through bore, wherein the disintegration device comprises protrusions protruding radially from the actuation device, and wherein the protrusions comprise at least one member of a group consisting of pins, spikes, blades, and knives.

2. The well tool device according to claim 1, further comprising a supporting element for supporting the actuation device in relation to the housing.

3. The well tool device according to claim 1, wherein a first section of the actuation device comprises the actuation tool connection interface and the at least one disintegration device, and wherein the actuation device is configured to be pushed downwardly in relation to the housing in order to provide disintegration of the frangible obstruction device.

4. The well tool device according to claim 1, wherein the first section of the actuation device comprises the actuation tool connection interface, wherein a second section of the actuation device comprises the at least one disintegration device, and wherein the actuation device is configured to be pulled upwardly in relation to the housing in order to provide disintegration of the frangible obstruction device.

5. The well tool device according to claim 1, wherein the actuation device comprises at least one radially protruding supporting section fixed to the housing by means of a shear pin.

6. The well tool device according to claim 1, wherein the protrusions have a tapering or pointed shape.

7. The well tool device according to claim 1, wherein the housing comprises a recess on an inner surface of the housing for receiving and supporting the at least one frangible obstruction device.

8. The well tool device according to claim 1, wherein the disintegration device is configured to be at least partially moved into the through opening of the at least one frangible obstruction device and thereby provide disintegration of the at least one frangible obstruction device.

9. A well tool device, comprising:

a housing comprising a longitudinal through bore having a first end and a second end;

at least one frangible obstruction device provided inside the longitudinal through bore, wherein fluid flow between the first end and the second end is prevented due to the frangible obstruction device;

wherein the housing prevents motion of the at least one frangible obstruction device in either direction parallel to the longitudinal through bore, wherein the at least one frangible obstruction device comprises a through opening, wherein the well tool device further comprises an actuation device extending fluid-tight at least into the through opening, wherein the actuation device comprises an actuation tool connection interface, wherein the actuation device comprises at least one disintegration device, wherein the at least one disintegration device is configured to be at least partially moved into the at least one frangible obstruction device and thereby provide disintegration of the at least one frangible obstruction device, hence allowing fluid flow between the first end and the second end of the longitudinal through bore; and a sleeve provided around the actuation device, wherein an outer diameter of the sleeve is larger than a diameter of the through opening, and wherein a shear pin is locking the sleeve to the actuation device.

10. The well tool device according to claim 9, further comprising a radial protrusion that is connected to a lower part or to a lower end of the actuation device.

* * * * *